US012312719B2

(12) United States Patent
Sauter et al.

(10) Patent No.: US 12,312,719 B2
(45) Date of Patent: May 27, 2025

(54) KNITTING TOOL

(71) Applicant: Groz-Beckert KG, Albstadt (DE)

(72) Inventors: Jörg Sauter, Albstadt (DE); Roland Simmendinger, Albstadt (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 18/267,934

(22) PCT Filed: Nov. 17, 2021

(86) PCT No.: PCT/EP2021/081984
§ 371 (c)(1),
(2) Date: Jun. 16, 2023

(87) PCT Pub. No.: WO2022/128297
PCT Pub. Date: Jun. 23, 2022

(65) Prior Publication Data

US 2024/0052537 A1 Feb. 15, 2024

(30) Foreign Application Priority Data

Dec. 16, 2020 (EP) ..... 20214742
Jul. 22, 2021 (DE) ..... 10 2021 119 011.8

(51) Int. Cl.
*D04B 35/02* (2006.01)

(52) U.S. Cl.
CPC ..... *D04B 35/02* (2013.01)

(58) Field of Classification Search
CPC ..... D04B 35/02; D04B 35/04; D04B 35/06; D04B 35/08; D04B 35/00
See application file for complete search history.

(56) References Cited

U.S. PATENT DOCUMENTS 885,590 A * 4/1908 Egly ..... D04B 35/02 66/123
3,805,362 A * 4/1974 Heaven ..... B21G 1/06 29/417
3,874,199 A * 4/1975 Mayer ..... D04B 35/04 66/123

(Continued)

FOREIGN PATENT DOCUMENTS

DE 3213158 A1 12/1982
DE 3612316 A1 10/1986

(Continued)

OTHER PUBLICATIONS

European Patent Office, International Search Report for PCT/EP2021/081984, dated Jan. 31, 2022, 5 pages.

(Continued)

*Primary Examiner* — Uyen T Nguyen
(74) *Attorney, Agent, or Firm* — Fitch, Even, Tabin & Flannery LLP

(57) ABSTRACT

In recent years, development in the field of knitting tools has seen a focus on the reduction of friction and wear. A knitting tool (1) and a knitting device (27) as described herein are better able to reduce friction in knitting machines and the accumulation of dirt (23) than conventional knitting tools. For this purpose, a functional portion (5) of the knitting tool (1) has subsections (7) in which the absolute value of the gradient of a center-of-gravity line (4) is greater than zero.

17 Claims, 12 Drawing Sheets

(56) References Cited

U.S. PATENT DOCUMENTS

| | | | | | |
|---|---|---|---|---|---|
| 3,875,767 | A * | 4/1975 | Kopal | D04B 35/04 | 66/123 |
| 3,994,145 | A * | 11/1976 | Stolz | D04B 35/04 | D15/78 |
| 4,434,627 | A * | 3/1984 | Pfrommer | D04B 35/02 | 66/120 |
| 4,452,053 | A * | 6/1984 | Egbers | D04B 35/04 | 66/123 |
| 4,625,527 | A * | 12/1986 | Fukuhara | D04B 35/04 | 66/123 |
| 5,154,069 | A * | 10/1992 | Speetjens | D04B 35/02 | 66/123 |
| 6,122,938 | A * | 9/2000 | Henning | D04B 35/02 | 66/123 |
| 7,117,692 | B1 * | 10/2006 | Su | D04B 35/02 | 66/92 |
| 2005/0016222 | A1 * | 1/2005 | Landenberger | D04B 35/04 | 66/119 |
| 2009/0229310 | A1 * | 9/2009 | Abe | D04B 35/04 | 66/123 |
| 2010/0083707 | A1 * | 4/2010 | Fehrenbacher | D04B 35/04 | 66/123 |
| 2012/0006064 | A1 * | 1/2012 | Haug | D04B 35/02 | 66/123 |

FOREIGN PATENT DOCUMENTS

| | | | |
|---|---|---|---|
| EP | 1860219 | A1 | 11/2007 |
| EP | 2927360 | A1 | 10/2015 |
| FR | 2260262 | A7 | 8/1975 |
| FR | 2941710 | A1 | 8/2010 |
| TW | 201604344 | A | 2/2016 |
| TW | 201905263 | A | 2/2019 |

OTHER PUBLICATIONS

European Patent Office, Written Opinion of the International Searching Authority for PCT/EP2021/081984, dated Jan. 31, 2022, 8 pages.

European Patent Office; Extended European Search Report in corresponding European Patent Application No. 20214742.7-1016 dated May 11, 2021; 22 pages.

Government of Pakistan, Intellectual Property Organization, The Patent Office, Karachi; Pakistani Office Action in corresponding Pakistan Application No. 914/2021 dated Jul. 20, 2022; 2 pages.

European Patent Office; Notification of the Transmission of the International Search Report and the Written Opinion of the International Searching Authority in corresponding application PCT/EP2021/081984; dated Feb. 18, 2022; 28 pages.

European Patent Office; First Office Action in corresponding European Patent Application No. 21 815 451.6-1017 dated Jul. 30, 2024; 10 pages.

Bangladesh Department of Patents, Industrial Designs, & Trademarks, Examination Report in Pat. App. No. 428/2021, dated Sep. 3, 2024.

Taiwan Intellectual Property Office (the Taiwan Patent Authority), Taiwanese Office Action and Search Report in corresponding Taiwanese Patent Application No. 11420171490, dated Feb. 14, 2025, 33 pages.

European Patent Office; Examination Report in corresponding European Patent Application No. 21 815 451.6, dated Apr. 23, 2025, 8 pages.

* cited by examiner

KNITTING TOOL

CROSS REFERENCE TO RELATED APPLICATIONS

This patent application is the national phase of PCT/EP2021/081984, filed Nov. 17, 2021, which claims the benefit of European Patent Application No. 20214742.7, filed Dec. 16, 2020, and German Patent Application No. 10 2021 119 011.8, filed Jul. 22, 2021.

TECHNICAL FIELD

Knitting tools for use in industrial knitting machines have been undergoing further development since the 19th century and continually have to meet new challenges posed by further advances in the field of knitting machines. Recent years have seen a focus on the reduction of friction and wear, particularly against the background of rising energy prices and production costs. Customary knitting tools have a shank, which extends in a longitudinal direction of the tool and which, at least in a functional portion, is designed to be guided in needle slots of knitting machines (both circular and flat knitting machines) and, within a specified operating area, to perform a substantially linear knitting motion in these needle slots in the tool's longitudinal direction. The force for this knitting motion is transmitted to the knitting tool via a butt, which projects above the shank of the knitting tool in an elevational direction that is at right angles to the tool's longitudinal direction. The butt is also acted on by a transverse force in a lateral direction that is at right angles to the tool's longitudinal direction and elevational direction. The transverse force leads to tilting of the knitting tool in the needle slot and is supported by contact with the side walls of the needle slot. On account of the knitting tool's tilt, it only makes linear contact with the needle slot at the top and bottom. The tilt of the knitting tool in a needle slot is shown clearly in FIG. 2 of EP1860219A1: the contact positions are marked there with oval circles.

BACKGROUND

FR2260262A7 describes a knitting tool with which the intention is to reduce the vibrations of the hook (loop-forming means) generated at high knitting speeds and thus to prevent needle breakage. For this purpose, the needle's rear shank section, which adjoins the butt (FIG. 1, 5), has a wavelike shape (FIGS. 1, 4*c* and 4*d*). This wavelike shape is intended to dampen vibrations in the needle's longitudinal direction.

DE3612316A1 describes a knitting tool intended to have improved shock absorption properties. For this purpose, the knitting tool has at least one elongate groove extending in the shank's longitudinal direction. FIG. 4 shows a special exemplary embodiment of a knitting tool of this type, which has arcuate cut-outs (FIG. 4, 11) along the shank. These cut-outs result in the formation of bridges, which are intended to reduce the weight of the knitting needle and confer a springy resilience on sections thereof.

DE3213158A1 describes a knitting tool having a hook element (loop-forming means) and a closure element; the hook of the hook element is closable by means of a relative movement between the closure element and the hook element. This kind of knitting tool is also referred to as a compound needle. FIG. 5 shows a special exemplary embodiment of this knitting tool, which has concavities (FIGS. 5, 7 and 9) suitable for receiving a thread. These concavities (FIGS. 5, 7 and 9) directly adjoin the hook element in the longitudinal direction and are not guided in a needle slot.

EP2927360A1 describes a knitting tool with a meandering shank, which has reduced-thickness portions and thereby reduces the friction between knitting tool and needle slot. The meandering shank has a plurality of shank portions which are mutually offset in the elevational direction and which extend in each case in the tool's longitudinal direction. These shank portions are interconnected by bridges extending in the elevational direction. The meandering shank of the knitting tool has no sections that are inclined with respect to the tool's longitudinal direction: all the shank sections either point exactly in the tool's longitudinal direction or enclose an angle of 90° with the tool's longitudinal direction.

The aforementioned EP1860219A1 describes a knitting tool whose shank has a functional portion. In a plane defined by the elevational and lateral directions, the height of the centre of gravity of the knitting tool's cross section varies within the functional portion with the position of the cross section in the tool's longitudinal direction. This is achieved by so-called "floating sections". These "floating sections" are spaced both from the underside of the knitting tool and from the top side of the knitting tool. The "floating sections", like the remaining sections of the functional portion, run parallel to the floor of the needle slot of the knitting machine in which the knitting tool is inserted—i.e. they run substantially in the longitudinal direction of the knitting tool. Accordingly, the height of the centre of gravity within the "floating sections" is constant. The "floating sections" are spaced from the top side and the underside of the knitting tool with the intention of reducing the contact surface between knitting tool and needle slot. The "floating sections" are interconnected by shank sections. These extend substantially in the tool's longitudinal direction, are disposed at the top side and underside of the knitting tool and are intended to form a linear contact surface with the needle slot. In a knitting-tool embodiment of this kind, spaces exist above and below the "floating sections", in which dirt can collect during knitting.

SUMMARY

One objective of the invention is accordingly to provide a knitting tool and a knitting system with which, compared to conventional knitting tools and knitting systems, friction is reduced and, in addition, less dirt collects.

A knitting tool having the following features:

a shank, which extends essentially in a tool's longitudinal direction, in which the tool is moved during knitting, wherein the shank has, at every point along its length, a cross-sectional surface which runs at right angles to the tool's longitudinal direction and is defined by its lateral and elevational directions, wherein each of these cross-sectional surfaces has a centroid, through which an imaginary centre-of-gravity line runs that interconnects the centroids of all the cross-sectional surfaces along the tool's longitudinal direction, wherein the shank has at least one functional portion, in which the centre-of-gravity line varies its height in the elevational direction (i.e. the centre-of-gravity line has no section in which the height of the centre-of-gravity line is constant—i.e. no section which runs substantially in the knitting tool's longitudinal direction. The second derivative of the centre-of-gravity line is accordingly not equal to zero if its gradient is zero), in which the height of the cross-sectional surface—the cross-sectional-surface height—is less at every point of the length of the functional portion than the shank height within the functional portion (the shank height is the distance, in the elevational direction, between the lowest point of the shank in the elevational direction and the highest point of the shank in elevational direction within its functional portion), wherein the length of the functional portion is more than 20%, preferably, however, more than 25% of the length of the entire knitting tool, is characterised in that the functional portion has subsections in which the absolute value of the gradient of the centre-of-gravity line is between 0 and ∞. The absolute value of the gradient of the centre-of-gravity line in the subsections is accordingly greater than zero. The gradient between two points of the centre-of-gravity line corresponds to the quotient of the height difference in elevational direction and the length difference in the tool's longitudinal direction between these two points of the centre-of-gravity line (gradient=height difference/length difference). The areas of the knitting tool for which no gradient can be calculated in this way (e.g. if the length difference between two points of the centre-of-gravity line is zero) are not subsections as defined by this patent application. Advantages are obtained if the absolute value of the gradient of the centre-of-gravity line in the subsections is between 0 and 3. Preferably, however, the absolute value of the gradient of the centre-of-gravity line in the subsections is between 0 and 1. It is advantageous if, for at least 50% of the length of the subsections, the absolute value of the gradient of the centre-of-gravity line is between 0.01 and 0.8, preferably, however, between 0.025 and 0.6. The centre-of-gravity line connects the centroids via the shortest path. In the subsections of the functional portion the centre-of-gravity line varies its height continuously—in other words, the height of the centre-of-gravity line does not remain constant but rises and/or falls in the elevational direction along its course in the tool's longitudinal direction. Advantages are obtained if the centre-of-gravity line varies its height in such a way that, viewed in an x-z plane, it "oscillates". The shape of the centre-of-gravity line is substantially due to a change relating to the knitting tool's cross section in the x-y plane and not to a change in density or material. Such a change may simply be a displacement of the cross section in elevational direction. Similarly, a top surface of the shank in the functional portion may have a continuously varying height and/or a bottom surface of the shank in the functional portion has a continuously varying height such that at least one of the top surface and bottom surface of the shank has no portion that extends parallel to the longitudinal direction within the at least one functional portion. It is advantageous if the knitting tool is produced by stamping. It is particularly beneficial if the knitting tool is a monolithic stamped part; the entire knitting tool then consists, as is preferable, of a single material and has essentially the same density throughout. On account of the gradient of the centre-of-gravity line, dirt in the shank area is pushed during the knitting movement of the knitting tool in the tool's longitudinal direction from the shank upwards, in positive elevational direction, and thus out of the knitting tool's operating area. The operating area in this context is the area in which the knitting tool can stay during its knitting movement. The knitting tool moves substantially in the tool's longitudinal direction. Dirt which comes into contact with the functional portion during this movement is acted on by a force directed at right angles to the surface of the knitting tool at the contact point. On account of the shape of the centre-of-gravity line, this force has directional components in the tool's movement direction and in the elevational direction. A self-cleaning effect is thus created in the operating area; dirt is removed and, in consequence, the reliability and service life of the knitting tool increased.

Further advantages are offered by a knitting tool according to the invention, which has at least one butt. The butt extends substantially in the elevational direction. The butt advantageously projects above the surrounding areas of the knitting tool in elevational direction. Driving forces and driving movements can be transmitted to the knitting tool via the butt. For use in knitting machines, this butt engages a cam with an arcuate cam curve, which, by means of a relative movement between the knitting tool and the stationary cam, transmits a knitting movement in the tool's longitudinal direction to the butt. Additional advantages are offered by a knitting tool having at least two butts. The teaching according to the invention can also be used to advantage with knitting tools comprising more than two butts.

It is also advantageous if the functional portion consists of at least two sub-portions, each of which has subsections in which the absolute value of the gradient of the centre-of-gravity line is between 0 and ∞, and these sub-portions are spaced apart from each other in the knitting tool's longitudinal direction. What is meant by the functional portion consisting of at least two sub-portions is that between these at least two sub-portions, there is an area of the knitting tool that does not belong to the functional portion. This may, for example, be an area in which the centre of gravity of the knitting tool's cross section does not vary its height, i.e. the height of which is constant. It is especially advantageous if the distance between the at least two sub-portions is at least exactly as large, but preferably 1.5 times as large, as the length of the butt, i.e. the butt length, in the tool's longitudinal direction. It is also to advantage if the butt is located between the at least two sub-portions.

Further advantages are obtained if the knitting tool has at least one sub-portion of the functional portion that precedes the butt as seen in the tool's longitudinal direction and at least one sub-portion of the functional portion that follows the butt as seen in the tool's longitudinal direction. As the point of force transmission for the driving forces during knitting, the butt is subjected to high loads. The preceding and following sub-portions of the functional portion can distribute and support the driving forces transmitted during knitting.

It is advantageous if a knitting tool according to the invention, in the case of which at least one sub-portion—preferably, however, two sub-portions—of the functional portion adjoin the butt directly or are spaced apart from the butt only by a distance, in the tool's longitudinal direction, which is less than or equal to 10% of the length of the entire knitting tool. A distance which is less than 5% of the length of the entire knitting tool is particularly advantageous.

It is advantageous if the functional portion has at least one local elevational extreme—maximum or minimum—of the centre-of-gravity line. At this at least one extreme, the gradient of the centre-of-gravity line is zero. These local extremes are adjoined on each side by the above-described subsections, in which the gradient of the centre-of-gravity line is between 0 and ∞. A transverse force acting on a knitting tool in a needle slot will cause the knitting tool to tilt and come into contact with the side walls of the needle slot in the vicinity of the local minima and maxima. Consequently, the transverse forces are supported there; contact points are created and, as a consequence of a knitting movement by the knitting tool, friction as well. It is particularly advantageous if, in the vicinity of local minima and maxima, the shank is configured in such a way that each of the contact points created here during knitting has a small contact surface.

Further advantages are obtained if at least two local elevational extremes of the centre-of-gravity line have the same height. It is particularly advantageous if at least two local minima and/or two local maxima have the same height. Additional advantages are obtained if at least two local maxima have the same height and a third local maximum has a lesser height. Similarly, it is to advantage if at least two local minima have the same height and a third local minimum has a greater height. It is particularly advantageous if the at least two local extremes of the centre-of-gravity line that have the same height are global extremes, i.e. the height of the centre-of-gravity line is not greater (global maximum) or smaller (global minimum) at any point.

It is advantageous if a knitting tool in the case of which the shank surface facing the knitting tool's positive elevational direction, that is, the direction in which the butt projects above the surrounding areas of the tool—from now on the top surface—has the same height at the positions, in the tool's longitudinal direction, of at least two local maxima of the centre-of-gravity line and/or the shank surface facing the knitting tool's negative elevational direction, that is, the direction pointing downwards towards the bed of the needle slot during knitting—from now on the bottom surface—has the same height at the positions of at least two local minima of the centre-of-gravity line. The positive elevational direction and the negative elevational direction are exactly opposite each other. It is particularly beneficial if, at the positions of the global maxima of the centre-of-gravity line, the top surface has the same height and/or, at the positions of the global minima of the centre-of-gravity line, the bottom surface has the same height.

Advantages are also offered by a knitting tool according to the invention in the case of which at least one local extreme has a surface which is raised laterally relative to the surface of most of the functional portion. As already described, a knitting tool in use in a knitting machine makes contact with a needle slot in the vicinity of the local extremes. If the surface is raised at these positions relative to the rest of the functional portion, a clearly defined contact surface is created at the raised positions and prevents other areas of the knitting tool from forming contact points with parts of the knitting machine—on account of manufacturing inaccuracies, for example. Further advantages are obtained if the surface is raised in such a way that predominantly punctiform contact points are formed with the knitting machine during knitting.

It is to advantage if, at the positions of local maxima of the centre-of-gravity line, the shank is spaced apart from the minimum shank height of the functional portion and, at the positions of local minima of the centre-of-gravity line, is spaced apart from the maximum shank height of the functional portion. It is particularly advantageous if this distance apart is at least half the magnitude of the maximum shank height of the functional portion.

Further advantages are obtained if at least one sub-portion of the functional portion comprises, in the x-z plane, at least one triangular recess and/or wavelike recess, which penetrates laterally through the functional portion. It is particularly advantageous if the height of the recess in elevational direction is at least 50%, preferably at least 65%, of the shank height.

Advantages are offered by a knitting tool according to the invention, in the case of which the shank surface facing the knitting tool's positive elevational direction—the top surface—has a gradient course which, in the tool's positive longitudinal direction, i.e. its extension direction, has a local gradient maximum in front of at least one local height maximum of the centre-of-gravity line and/or the shank surface facing the knitting tool's negative elevational direction—the bottom surface—has a gradient course which, in the tool's positive longitudinal direction, i.e. its extension direction, has a local gradient minimum in front of at least one local height minimum of the centre-of-gravity line. The tool's positive longitudinal direction, or its extension direction, is the tool direction towards the shank end at which the loop-forming element is located. At the positions described, the bottom and top surfaces thus form "dirt catches", which, on account of the gradient course of the surface, propel dirt preferably in the tool's negative longitudinal direction. The dirt is thus propelled away from the formed loops or knitted textile.

It is particularly beneficial if the absolute value of the local gradient maximum of the shank surface facing the knitting tool's positive elevational direction—the top surface—and/or of the local gradient minimum of the shank surface facing the knitting tool's negative elevational direction—the bottom surface—has a value between 0.57 and 2.75. Preferably, however, the absolute value of the local gradient maximum of the top surface and/or the local gradient minimum of the bottom surface is between 0.83 and 1.74. Further advantages are obtained if the absolute value of the local gradient minimum of the bottom surface is greater than the absolute value of the local gradient maximum of the top surface.

Additional advantages are obtained if the shank surface facing the knitting tool's positive elevational direction—the top surface—and the shank surface facing the knitting tool's negative elevational direction—the bottom surface—are substantially parallel to each other in the subsections of the functional portion. The top surface and the bottom surface are parallel to each other at least section-wise. Consequently, material and stress distribution is consistent in these subsections. It is particularly advantageous if the top surface and the bottom surface are substantially parallel in the entire functional portion.

It is advantageous if the last maximum of the centre-of-gravity line of the functional portion, viewed in the tool's negative longitudinal direction, opposite the extension direction, is a global maximum. Additional advantages are obtained if this last maximum in the tool's longitudinal direction is spaced from the end of the knitting tool, viewed in its negative longitudinal direction, by a maximum of 30 mm, preferably, however, by a maximum of 15 mm. In this way, the knitting tool is prevented from tilting or twisting about an axis running in the lateral direction and good guidance of the knitting tool in knitting machines is achieved.

The objective is also achieved by means of a knitting device having at least one needle slot, which is configured to receive and, during operation, to guide a knitting tool, and at least one knitting tool having the following features:

- a shank, which extends mostly in a tool's longitudinal direction, in which the tool is moved during knitting, wherein the shank has, at every point along its length, a cross-sectional surface defined by its lateral and elevational directions, wherein each of these cross-sectional surfaces has a centroid, through which an imaginary centre-of-gravity line runs that interconnects the centroids of all the cross-sectional surfaces along the tool's longitudinal direction, wherein the shank has at least one functional portion in which the centre-of-gravity line varies its height in which the height of the cross-sectional surface is less at every point along the length of the functional portion than the shank height within the functional portion, which is the distance, in the elevational direction, between the lowest point of the shank in the elevational direction and the highest point of the shank in elevational direction within its functional portion, wherein the length of the functional portion is more than 20%, preferably, however, more than 25% of the length of the entire knitting tool.

The functional portion additionally has subsections, in which the absolute value of the gradient of the centre-of-gravity line is between 0 and co. In the subsections, accordingly, the centre-of-gravity line encloses an angle greater than 0° and less than 90° relative to the tool's longitudinal direction. This means, in particular, that in the subsections the centre-of-gravity line is not parallel to the tool's longitudinal direction. This shape of the centre-of-gravity line is due to a change or a "shift" relating to the knitting tool's cross section in the x-y plane and not to a change in density or material.

Additional advantages are obtained if the length of the needle slot in the knitting tool's longitudinal direction, the reach of the functional portion in the knitting tool's longitudinal direction and the magnitude of the stroke of the knitting tool's knitting movement during knitting are mutually coordinated such that at least 80%, advantageously 90%, but preferably 100% of the reach of the functional portion, in the knitting tool's longitudinal direction, remains within the needle slot during knitting. The reach of the functional portion in the tool's longitudinal direction describes the position of the functional portion in the tool's longitudinal direction relative to other parts of the knitting tool. The reach of the functional portion is the zone, in the tool's longitudinal direction, between the front and rear limits of the functional portion in the tool's longitudinal direction. If a functional portion has a plurality of subsections which are spaced apart from each other in the tool's longitudinal direction, the reach of the functional portion also includes those areas of the knitting tool which are located between these subsections—for example, a butt located between two subsections. The knitting tool is guided in its functional portion by the needle slot, and driving forces are supported in the needle slot. Contact areas exist between the functional portion of the knitting tool and the needle slot. If too great a sub-portion of the functional portion were to exit the needle slot during knitting, the needle would be guided less well as a result. The above-mentioned selection ranges have proved advantageous in order to guarantee good guidance of the knitting tool. Ideally, the guiding portion of the knitting tool remains completely within a needle slot during the entire knitting movement, i.e. does not project out of a needle slot, particularly in the tool's longitudinal direction.

Further advantages are obtained if the upper edge of the needle slot is spaced in the elevational direction by a maximum of 0.5 mm, preferably, however, by a maximum of 0.3 mm, from the highest point of the shank surface facing the knitting tool's elevational direction, i.e. of the top surface. This distance is referred to from now on as the elevational distance. It is advantageous if the elevational distance is as small as possible. Advantages are obtained if the upper edge of the needle slot is higher or as high as the top surface at its highest point in positive elevational direction. In this way, it is ensured that the knitting tool's functional portion will form a contact area with the needle slot at the position of at least one local maximum and that, in particular, no contact areas are formed with the needle slot in the subsections of the functional portion. It is especially beneficial if the upper edge has substantially the same height in elevational direction as the top surface at its highest point in positive elevational direction.

It is also to advantage if the knitting tool of the knitting device has a butt, which is raised in the positive elevational direction relative to the functional portion and which engages in a recess of the knitting device—the cam curve—, and if the highest point, in positive elevational direction, of the shank surface facing the positive elevational direction of the knitting tool—the top surface (10)— is spaced apart from the cam curve in the tool's longitudinal direction (z). In this way, the top surface of the knitting tool is prevented from accidentally engaging the cam curve at these points. Accidental engagement could cause the knitting tool to jam, with resultant damage to the knitting tool and/or the knitting device. The distance in the tool's longitudinal direction between the highest point, in positive elevational direction, and the cam curve is the safety distance. The safety distance is advantageously greater than zero.

DETAILED DESCRIPTION

Figure 1:
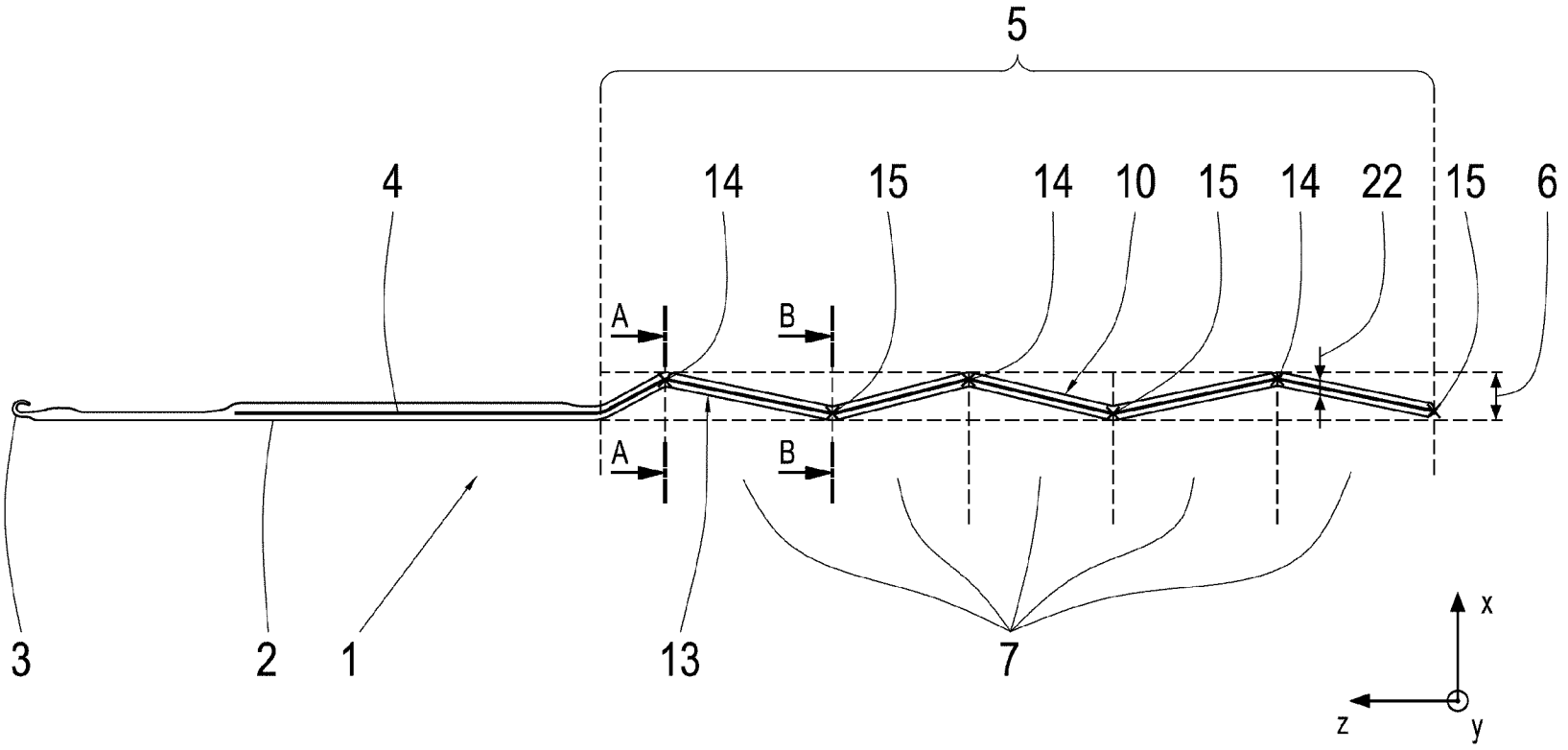
FIG. 1 shows a knitting tool (1), which has a functional portion (5).

FIG. 1 shows a knitting tool 1 having a shank 2, which extends predominantly in the tool's longitudinal direction z and has a loop-forming element 3 shaped as a hook at its first end as viewed in the tool's positive longitudinal direction z. The shank 2 has, at every point along its length in the tool's longitudinal direction, a cross-sectional surface 8 which lies in the plane defined by the lateral direction y and the elevational direction x. In the functional portion 5, the height of this cross-sectional surface 8, i.e. the cross-sectional-surface height 22, in the elevational direction x is smaller at every point than the shank height 6. The shank height 6 is the height between the minimum and maximum extension of the functional portion 5 in the elevational direction x. The cross-sectional surface 8 and the centroid 9 of a cross section are shown by way of example in FIG. 2. FIG. 1 shows a centre-of-gravity line 4, which interconnects all the centroids 9 of these cross-sectional surfaces 8 of the shank via the shortest path. In the exemplary embodiment shown in FIG. 1, this centre-of-gravity line 4 comprises three local maxima 14 and three local minima 15. Other advantageous embodiments of the knitting tool 1 may, however, have more or fewer local maxima 14 and/or local minima 15. In the area of the three local maxima 14, the top surface 10 has the same height. In the area of the three local minima 15, the bottom surface 13 has the same height in elevational direction x. In the subsections 7 of the functional portion 5, the centre-of-gravity line 4 has a gradient greater than 0. In these subsections 7, therefore, the shank 2 is tilted with respect to the tool's longitudinal direction z and, in particular, does not run parallel to the tool's longitudinal direction z.

Figure 2:
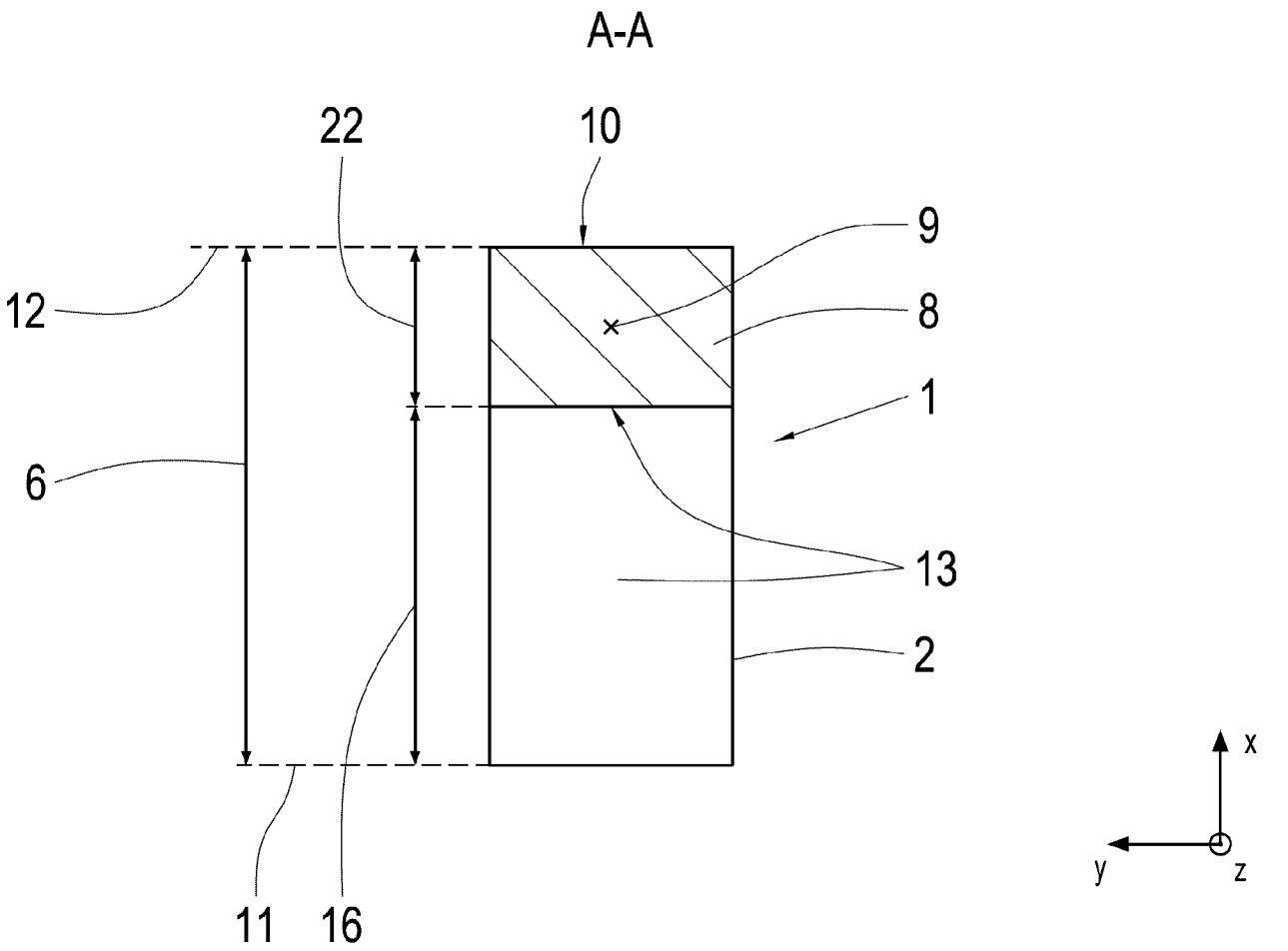
FIG. 2 shows the A-A section through the functional portion (5) of the knitting tool (1) at the position of a local maximum (14) in the centre-of-gravity line (4).

FIG. 2 shows the A-A section, the position of which is shown in FIG. 1 and which goes through the shank 2 in the functional portion 5 at the position of a local maximum 14 in the centre-of-gravity line 4. Parts of the functional portion 5 are shown, wherein the functional portion 5, taken as a whole, extends over the entire shank height 6. The shank height 6 is delimited in positive elevational direction x by the maximum shank height 12 and in negative elevational direction x by the minimum shank height 11. The cross-sectional surface 8 is shown with hatching and has a centroid 9 which, seen in elevational direction x and lateral direction y, "lies" in the centre of the cross-sectional surface 8. The cross-sectional surface 8 is delimited downwardly, in negative elevational direction x, by the bottom surface 13 of the knitting tool 1. The bottom surface 13 is also visible in FIG. 2 in an area that lies outside the sectional plane and continues beneath the cross-sectional surface 8. The cross-sectional surface 8 is delimited upwardly, in positive elevational direction x, by the top surface 10 of the knitting tool 1. The top surface 10 is at the level of the maximum shank height 12. At the position of the cross-sectional surface 8, the bottom surface 13—and thus the shank 2—is, by contrast, spaced apart from the minimum shank height 11 by the bottom distance 16. In other words, beneath the local maximum 14, in negative elevational direction x, a "clearance" exists between the shank 2 and the minimum shank height 11.

Figure 3:
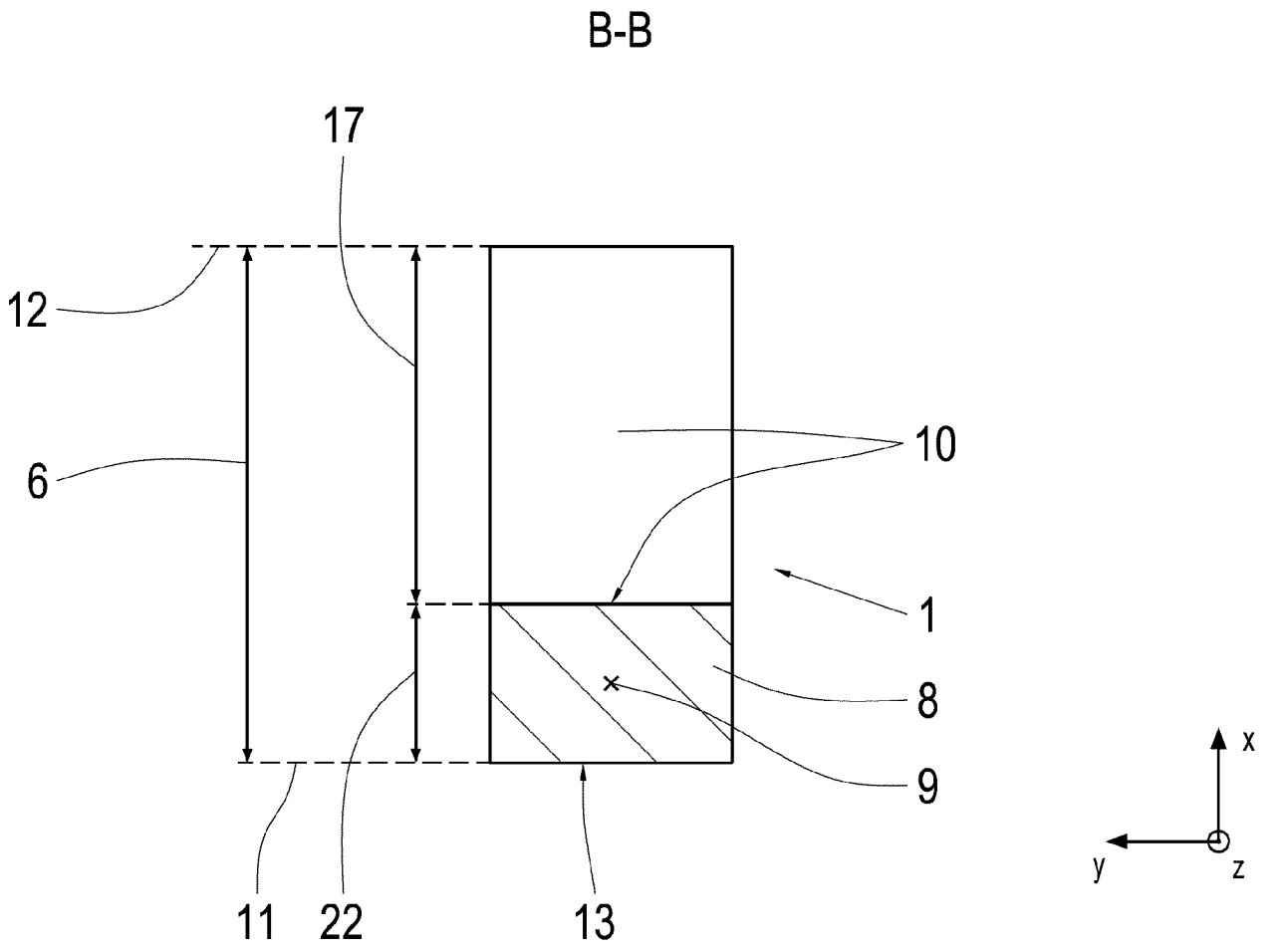
FIG. 3 shows the B-B section through the functional portion (5) of the knitting tool (1) at the position of a local minimum (15) in the centre-of-gravity line (4).

FIG. 3 shows the B-B section, the position of which is also shown in FIG. 1 and which goes through the shank 2 in the functional portion 5 at the position of a local minimum 15 in the centre-of-gravity line 4. Parts of the functional portion 5 are shown, wherein the functional portion 5, taken as a whole, extends over the entire shank height 6. The shank height 6 is delimited in positive elevational direction x by the maximum shank height 12 and in negative elevational direction x by the minimum shank height 11. The cross-sectional surface 8 is shown with hatching and has a centroid 9 which, seen in elevational direction x and lateral direction y, "lies" in the centre of the cross-sectional surface 8. The cross-sectional surface 8 is delimited upwardly, in positive elevational direction x, by the top surface 10 of the knitting tool 1. The top surface 10 is also visible in FIG. 3 in an area that lies outside the sectional plane and continues above the cross-sectional surface 8. The cross-sectional surface 8 is delimited downwardly, in negative elevational direction, by the bottom surface 13 of the knitting tool 1. In FIG. 3, the bottom surface 13 is at the level of the minimum shank height 11. At the position of the cross-sectional surface 8, the top surface 10 is, by contrast, spaced apart from the maximum shank height 12 by the top distance 17. In other words, above the local minimum 15, in positive elevational direction x, a "clearance" exists between the shank 2 and the maximum shank height 12.

Figure 4:
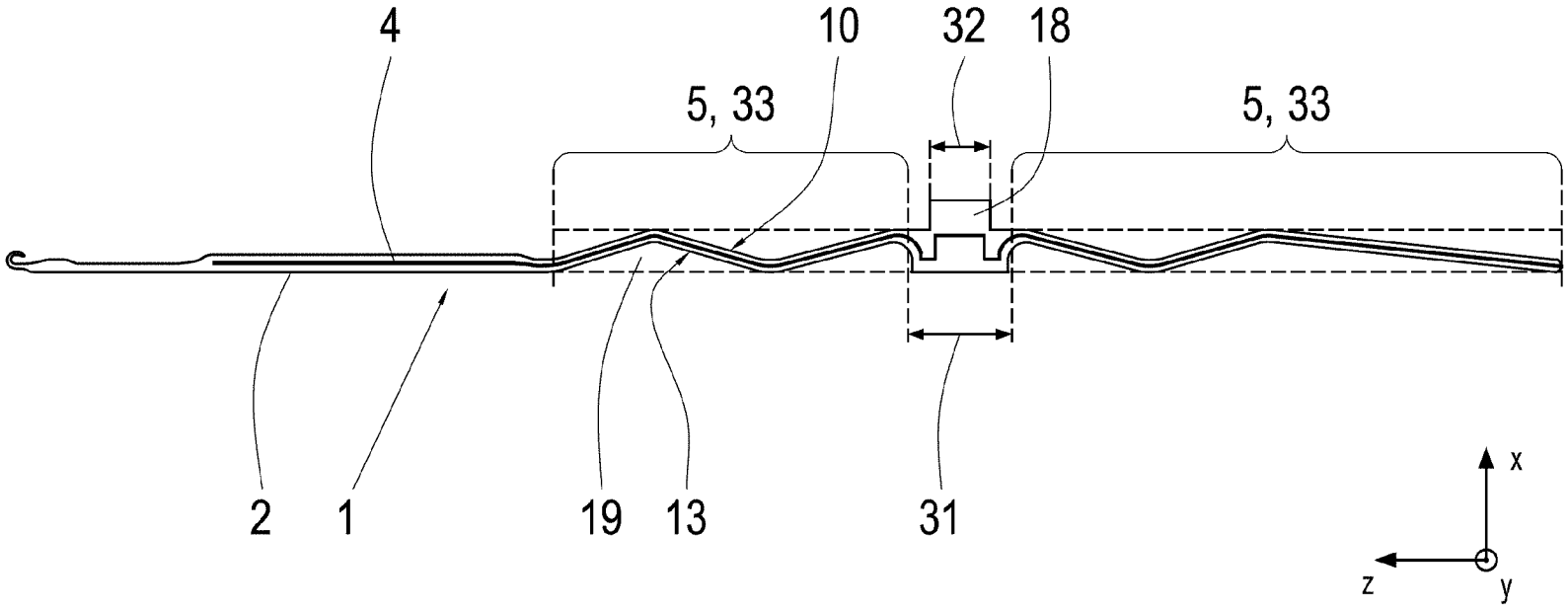
FIG. 4 shows a knitting tool (1), which has triangular recesses (19) in the functional portion (5).

FIG. 4 shows a knitting tool 1 according to the invention, having a butt 18, which, during knitting, is suitable for taking up driving forces and driving movements and transmitting them to the knitting tool 1. In front of and behind the butt 18, viewed in the tool's positive longitudinal direction z, are two adjoining sub-portions 33 of the functional portion 5. Together, the two sub-portions 33 form the functional portion 5. They are spaced apart from each other in the tool's longitudinal direction z by a functional-portion distance 31, which is approximately 1.5 times as large as the butt length 32 of the butt 18. In this exemplary embodiment, the butt 18 is located between the two sub-portions 33 of the functional portion 5. The shape of the shank 2 in the sub-portions 33 of the functional portion 5 has a plurality of triangular recesses 19. These triangular recesses 19 have a substantially triangular geometry in the x-z plane and "penetrate" completely through the shank 2 of the knitting tool 1 in the lateral direction. The top surface 10 and the bottom surface 13 of the shank 2 are substantially parallel to each other in the functional portion 5.

Figure 5:
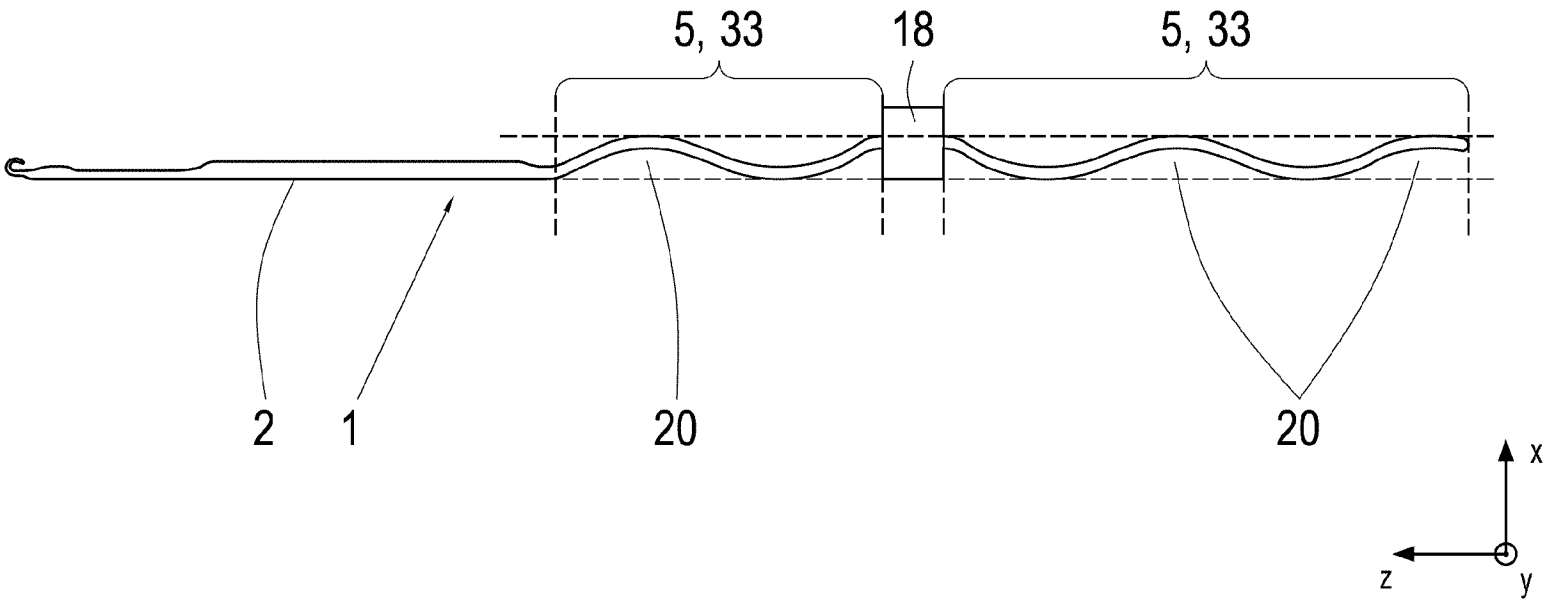
FIG. 5 shows a knitting tool (1), which has wavelike recesses (20) in the functional portion (5).

FIG. 5 shows a knitting tool 1 according to the invention, which also comprises a butt 18 and a functional portion 5 having two sub-portions 33. Contrary to the shape of the embodiment of FIG. 4, the shape of the shank 2 in the sub-portions 33 has a plurality of wavelike recesses 20. These wavelike recesses 20 have a substantially wavelike or arcuate geometry in the x-z plane and "penetrate" completely through the shank 2 of the knitting tool 1 in the lateral direction—One of the two sub-portions 33 is disposed in front of the butt 18 in the tool's longitudinal direction z, the other of the two sub-portions 33 is disposed behind the butt 28 in the tool's longitudinal direction z. The two sub-portions 33 directly adjoin the butt 18. Accordingly, no space exists between the sub-portions 33 and the butt 18 in the tool's longitudinal direction. The last maximum in the centre-of-gravity line 4 of the functional portion 5, viewed in the tool's negative longitudinal direction z, opposite the direction of extension, is a global maximum of the functional portion 5. The knitting tool 1 is supported and guided particularly well by this global maximum in that the knitting tool 1 is prevented from tilting about an axis running in the lateral direction y.

Figure 6:
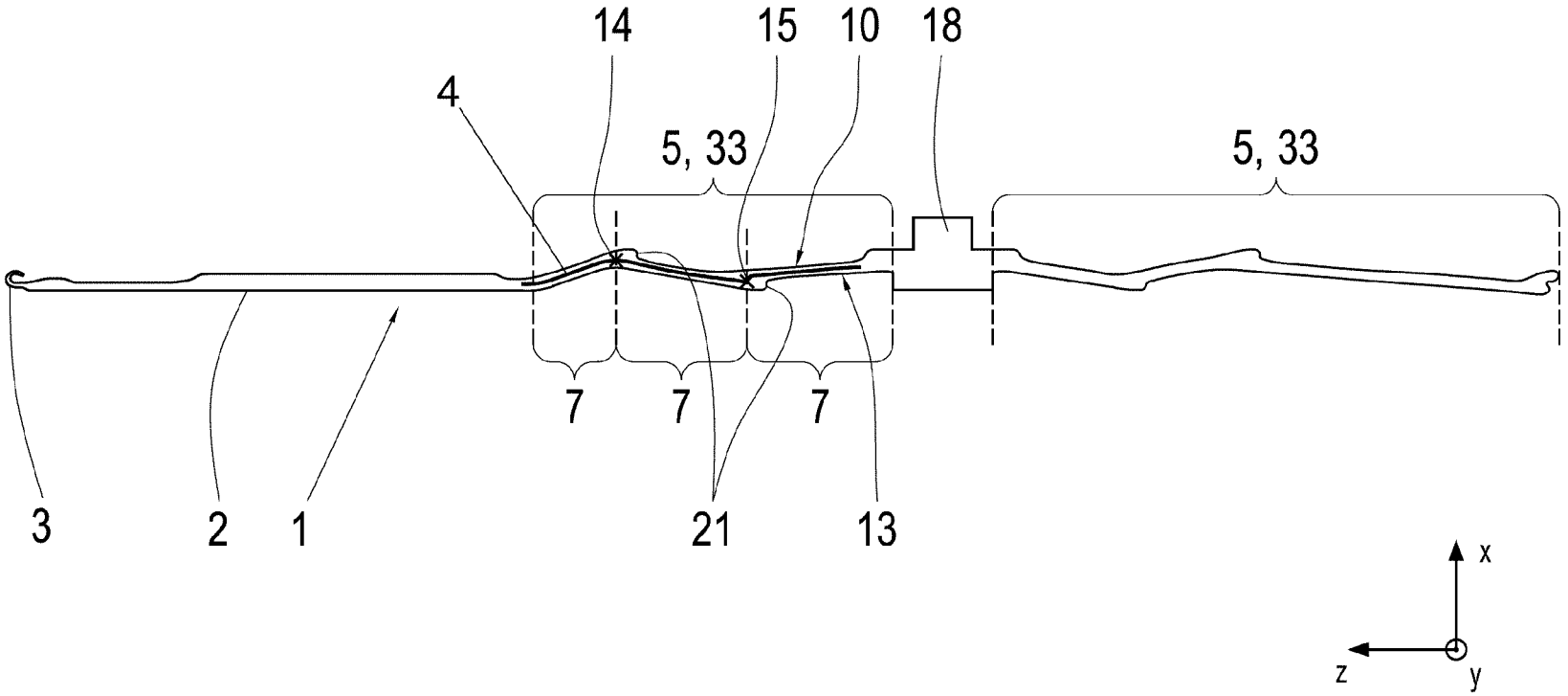
FIG. 6 shows a knitting tool (1) whose surface in the area of local minima (15) and maxima (14) in the centre-of-gravity line (4) has dirt catches (21).

FIG. 6 shows a knitting tool 1 according to the invention, which comprises a butt 18 and a guiding portion 5, said guiding portion 5 comprising two sub-portions 33. In its guiding portion 5, the shank 2 has subsections 7 in which the shank 2 and the centre-of-gravity line 4 are substantially linear and are tilted at a constant angle with respect to the tool's longitudinal direction z—the absolute value of the gradient of the centre-of-gravity line 4 is accordingly greater than 0. In the area of each local maximum 14, the top surface 10 of the shank 2 has a dirt catch 21. In the area of each local minimum 15, the bottom surface 13 of the shank 2 has a dirt catch 21. In the case of a dirt catch 21, which, viewed in the tool's positive longitudinal direction, is located in front of a local maximum 14 in the centre-of-gravity line 4, the top surface 10 of the shank 2 has a gradient which has a local maximum in front of the local maximum 14 of the centre-of-gravity line 4. In the case of a dirt catch 21, which, viewed in the tool's positive longitudinal direction, is located in front of a local minimum 15 in the centre-of-gravity line 4, the bottom surface 13 of the shank 2 has a gradient which has a local minimum in front of the local minimum 15 of the centre-of-gravity line 4. The top surface 10 and the bottom surface 13 are thus tilted more strongly with respect to the tool's longitudinal direction—in other words, the absolute value of the gradient is greater than in the adjoining subsection 7 of the shank 2. During the reverse movement of the knitting tool 1, in the tool's negative longitudinal direction z, the dirt catches 21 increase dirt transport in the tool's negative longitudinal direction z. In this way, dirt is kept away from the part of the knitting tool 1 that comprises the loop-forming element 3. Potential soiling of the formed loops and of the textile is reduced.

Figure 7:
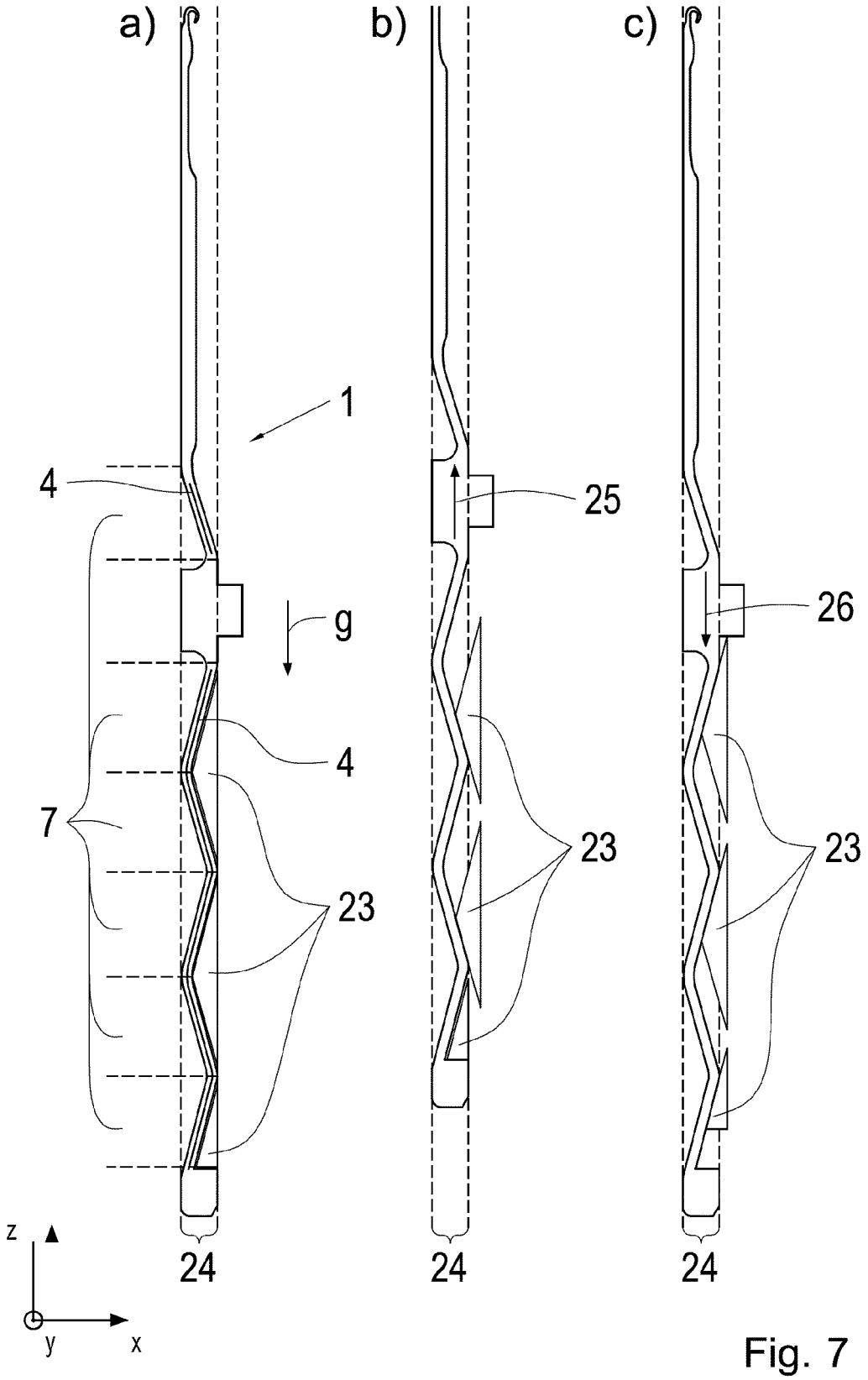
FIG. 7 shows the three sub-steps in which dirt (23) is removed from the operating area (24) of the knitting tool (1).

FIG. 7 shows the principle according to which the "self cleaning" of the knitting tool works, by way of example in three steps: In the starting position—here step a)—dirt 23 has collected in the operating area 24 of the knitting tool 1. In this context, dirt 23 may be composed of large numbers of fibres, dust particles and abraded particles. The centre-of-gravity line 4, which is not shown in this drawing for reasons of better clarity, runs between local maxima 14 and minima 15 and clearly has a gradient which is greater than 0. In step b) of FIG. 7, the knitting tool 1 is shown during a forward movement 25. On account of the rising centre-of-gravity line 4 in the subsections 7, the dirt 23 is pushed during the forward movement 25 of the knitting tool 1 in the tool's positive longitudinal direction z and the elevational direction x. In step c) of FIG. 7, the knitting tool 1 is shown during a reverse movement 26. On account of the movement of the knitting tool 1 and the rising centre-of-gravity line 4, the dirt 23 is pushed in the tool's negative longitudinal direction z and the elevational direction x. In the drawing, the knitting tools 1 are arranged in a knitting machine in such a way that the tool's longitudinal direction z is upright; accordingly, gravitational acceleration g points in the tool's negative longitudinal direction z. Any dirt 23 that protrudes above the knitting tool in the elevational direction because it was pushed out of the operating area 24 will therefore fall out of the knitting machine on account of its weight, which results from the earth's acceleration g. In all embodiments of the teaching according to the invention, dirt 23 protruding from the operating area 24 will additionally be "abraded" by relative movement between the knitting tool 1 and the cam element 29 or a dial (in the case of horizontally disposed knitting tools). Accordingly, soiling of the knitting tool 1 and of the knitting device 27 is reduced.

Figure 8:
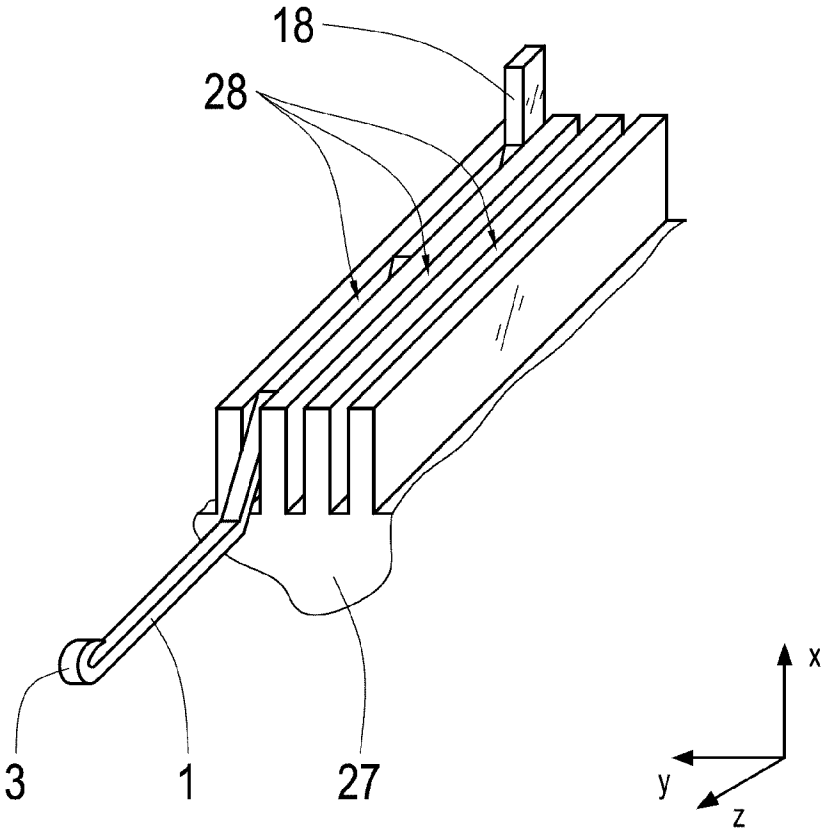
FIG. 8 shows a knitting device (27) comprising three needle slots (28), one of which is fitted with a knitting tool (1).

FIG. 8 shows part of a knitting device 27 comprising three needle slots 28. The leftmost of the three needle slots 28 in FIG. 8 is fitted with a knitting tool 1—in this case a knitting needle whose loop-forming element 3 is a hook. The middle and right-hand needle slots 28 have not been fitted with a knitting tool 1 so that the needle slots 28 can be shown better. Normally, all the needle slots 28 are fitted with a knitting tool 1 during knitting. The knitting tool 1 comprises a butt 18, which projects above the rest of the knitting tool 1 and the needle slot in elevational direction x.

Figure 9:
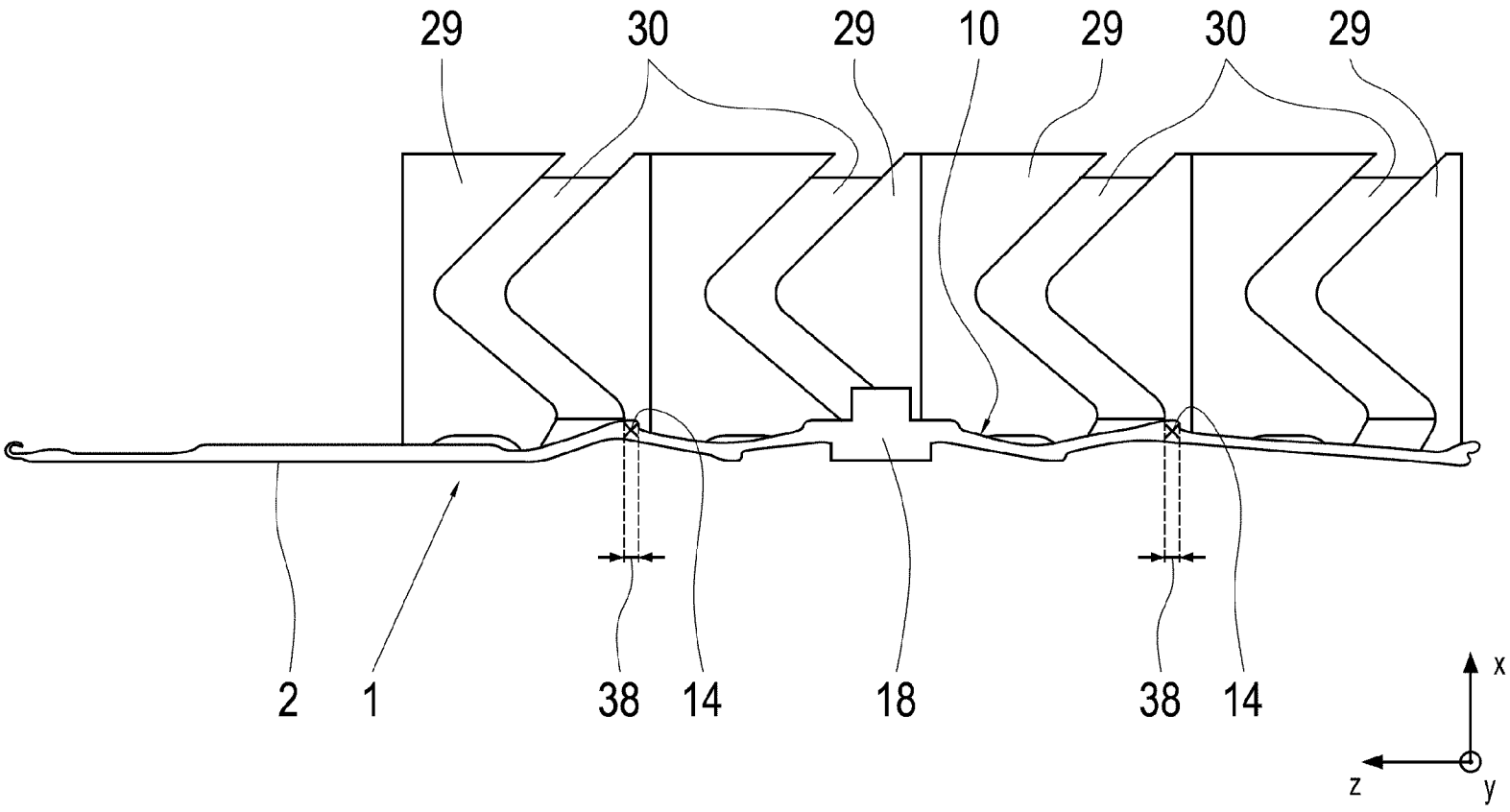
FIG. 9 shows four cam elements (29) of a knitting device (27) and a knitting tool (1).

FIG. 9 shows a knitting tool 1 and four cam elements 29, each of which comprises a cam curve 30. Butts 18 of knitting tools 1 are able to engage in each of the four cam curves and initiate a movement in the tool's longitudinal direction in the respective knitting tool 1, said movement resulting from a relative movement between the knitting tool 1 and the cam element 29. In order to depict the position of the cam element 29 relative to the knitting tool 1 and the shape of the cam curves more clearly, the cam element 29 is shown rotated by 90° about the tool's longitudinal axis z. In the correct installation position, the recesses of the cam curves 30 are in fact open in the negative elevational direction x, so that the butt 18 of the knitting tool can engage, in the elevational direction x, in one of the cam curves 30. The centre-of-gravity line 4 of the knitting tool 1 has two local maxima 14, at the position of which the highest points, in positive direction x, of the top surface 10 are also located. For purposes of clarity, the drawing does not show the whole centre-of-gravity line 4 but only its two local maxima 14. These highest points of the top surface 10 are spaced apart, in the tool's longitudinal direction z, from the cam curves 30 by a safety distance 38, which is greater than zero. In this way, the shank 2 of the knitting tool 1 is prevented from undesirably "hooking into" one of the cam curves 30 and influencing the drive motion of the knitting tool 1 or causing the knitting tool 1 to jam.

Figure 10:
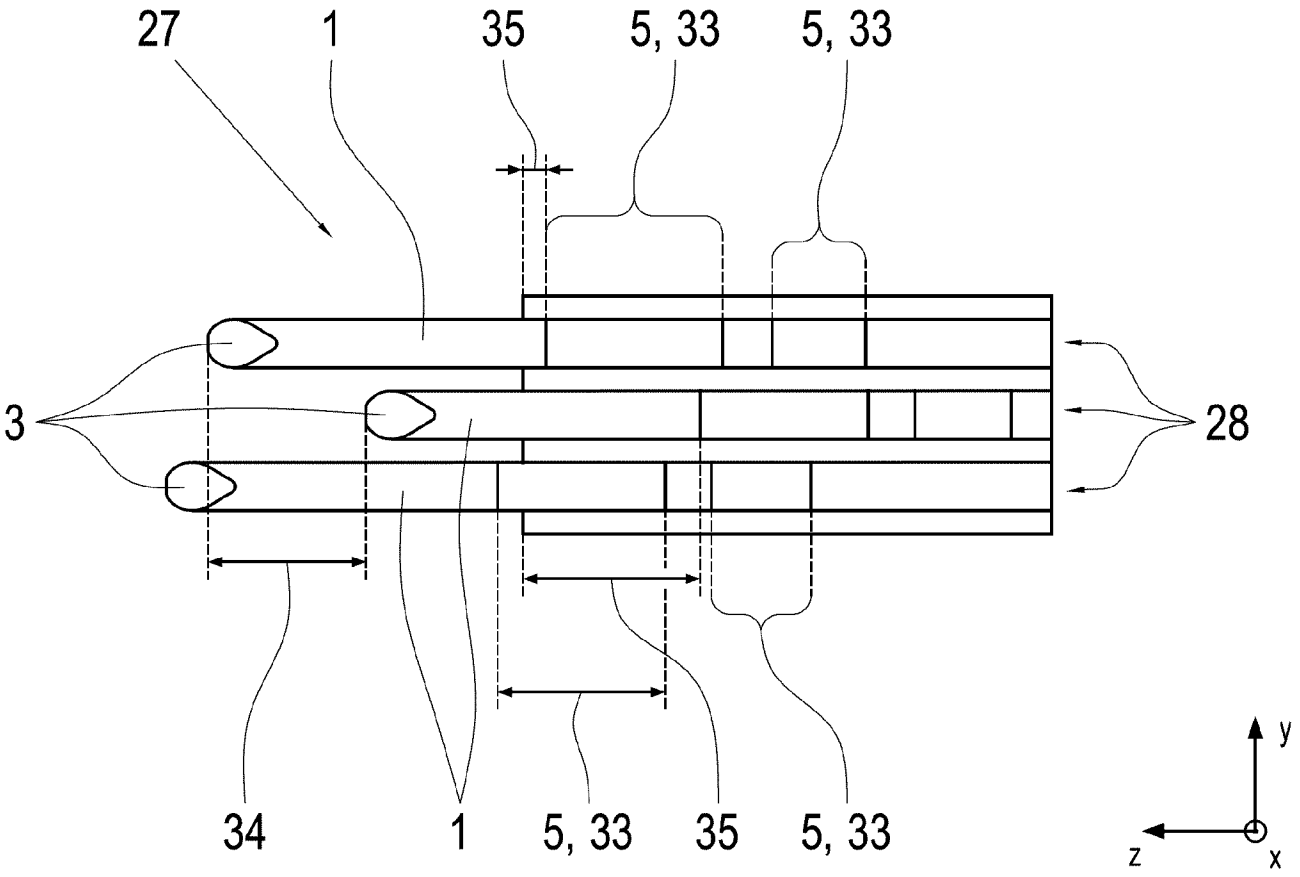
FIG. 10 shows the top view of a knitting device (27) having three needle slots (28), each of which is fitted with a knitting tool (1).

FIG. 10 is a top view of a knitting device 27 comprising three needle slots 28. In each of the three needle slots 28 is a knitting tool 1 comprising a functional portion 5, which has two sub-portions 33. The uppermost and the lowermost of the three knitting tools 1 are shown in an extended state. They show two different variants of an extended state. For one knitting movement there is only one extended state. In FIG. 10, however, both variants are shown in one drawing. In the extended state, a knitting tool has reached the furthest position of the knitting movement in the tool's positive longitudinal direction z. In the case of the first extended-state variant, shown in FIG. 10 with the uppermost of the three knitting tools 1, the functional portion 5 of the knitting tool 1 is accommodated completely in the uppermost needle slot 28 and has an edge distance 35 to the front edge of the needle slot 28. The middle knitting tool 1 of the three is shown in a retracted state. It has reached the furthest position of the knitting movement in the tool's negative longitudinal direction z. The distance, in the tool's longitudinal direction z, between the loop-forming elements 3 of the middle and uppermost knitting tools in FIG. 10 corresponds to the stroke 34 of the knitting movement. The lowermost knitting tool 1 in the drawing is shown in a second variant of the extended state. The magnitude of the stroke 34 is so large in this case that the functional portion 5 exits the needle slot 28 during knitting. At least 80% of the length, in the tool's longitudinal direction z, of the functional portion 5 of the knitting tool 1 always remains within the slot 28 during knitting.

Figure 11:
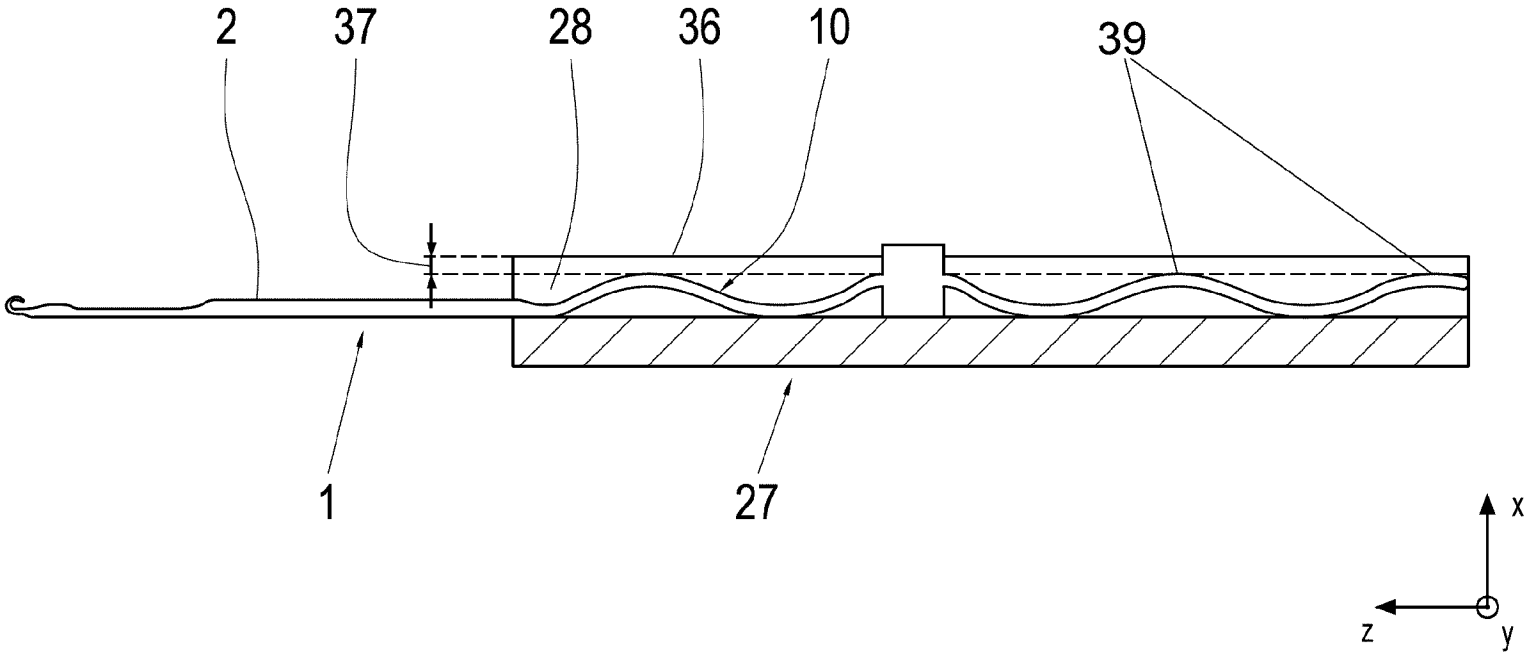
FIG. 11 shows the section, in the x-z plane, through a needle slot (28) fitted with a knitting tool (1).

FIG. 11 shows a sectional view of a knitting device 27. The section lies in the x-z plane and goes through a needle slot 28 fitted with a knitting tool 1. The upper edge 36 of the needle slot 28 is spaced apart from the highest point 39 of the top surface 10 of the knitting tool 1— and accordingly also from the shank 2—by the elevational distance 37. In positive elevational direction x, the upper edge 36 is higher than the highest point of the top surface 10. Also advantageous for all embodiments of the invention is a needle slot 28, the upper edge 36 of which is at the same height in positive elevational direction x as the highest point of the top surface 10. In this case the elevational distance 37 would be zero.

Figure 12:
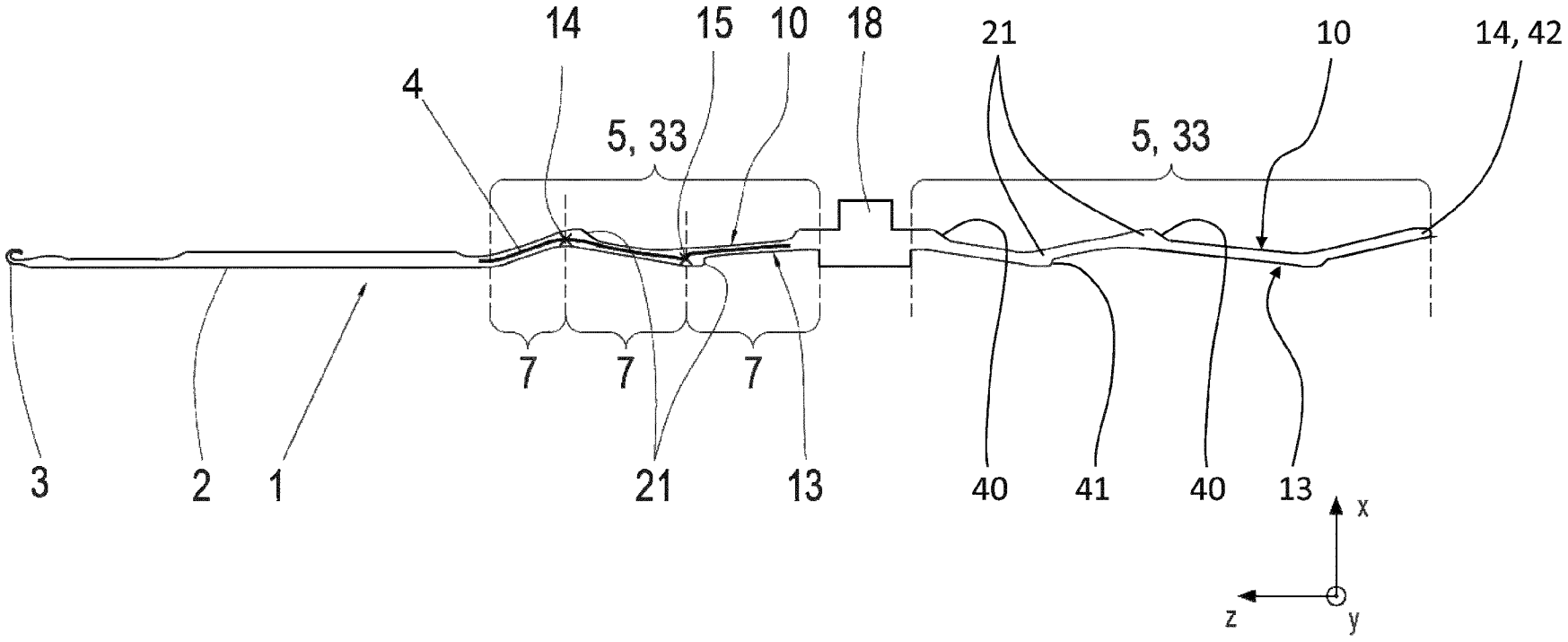
FIG. 12 shows a knitting tool (1) in the case of which the absolute value of the local gradient maximum (40) of the top surface (10) is smaller than the absolute value of the local gradient minimum (41) of the bottom surface (13).

FIG. 12 shows a further exemplary embodiment of a knitting tool 1, which has essentially the same features as the knitting tool 1 of FIG. 6. Compared to FIG. 6, the knitting tool 1 has a top surface 10 with local gradient maxima 40 having absolute values smaller than the local gradient minima 41 of the bottom surface 13. During knitting, a knitting tool 1 of this kind causes lower frictional forces in the needle slot of a knitting device because the flatter gradient of the top surface 10 makes for better guidance and more fluid motion of the knitting tool 1. The knitting tool 1 differs additionally from the knitting tool 1 shown in FIG. 6 in that the last maximum 14, viewed in the tool's negative longitudinal direction z, i.e opposite to the extension direction, of the centre-of-gravity line 4 of the functional portion 5 is a global maximum 42. Although this global maximum 42 is spaced, in the tool's longitudinal direction z, from the end of the knitting tool 1 as seen in its negative longitudinal direction z, the distance is selected to be as small as possible. In this way, the knitting tool 1 is prevented from tilting or twisting about an axis running in the lateral direction y. This measure, too, makes for better guidance and fluid movement of the knitting tool 1 during knitting. The above-described features change the shape of the dirt catches 21 formed by the top surface 10 compared to the exemplary embodiment of FIG. 6, but this form of dirt catch 21 has proved to support the self-cleaning effect already described above with regard to the embodiment of FIG. 7.

| List of reference numerals | |
|---|---|
| 1 | Knitting tool |
| 2 | Shank |
| 3 | Loop-forming element |
| 4 | Centre-of-gravity line |
| 5 | Functional portion |
| 6 | Shank height |
| 7 | Subsection |
| 8 | Cross-sectional surface |
| 9 | Centroid |
| 10 | Top surface |
| 11 | Minimum shank height |
| 12 | Maximum shank height |
| 13 | Bottom surface |
| 14 | Local maximum of centre-of-gravity line 4 |
| 15 | Local minimum in centre-of-gravity line 4 |
| 16 | Bottom distance |
| 17 | Top distance |
| 18 | Butt |
| 19 | Triangular recess |
| 20 | Wavelike recess |
| 21 | Dirt catch |
| 22 | Cross-sectional-surface height |
| 23 | Dirt |
| 24 | Operating area |
| 25 | Forward movement |
| 26 | Reverse movement |
| 27 | Knitting device |
| 28 | Needle slot |
| 29 | Cam element |
| 30 | Cam curve |
| 31 | Functional-portion distance |
| 32 | Length of butt (18) |
| 33 | Sub-portion of functional portion (5) |
| 34 | Stroke of knitting movement |
| 35 | Edge distance |
| 36 | Upper edge of needle slot (28) |
| 37 | Elevational distance |
| 38 | Safety distance |
| 39 | Highest point of top surface (10) |

-continued

| List of reference numerals | |
|---|---|
| 40 | Local gradient maximum of top surface (10) |
| 41 | Local gradient minimum of bottom surface (13) |
| 42 | Global maximum of centre-of-gravity line (4) |
| x | Elevational direction |
| y | Lateral direction |
| z | Tool's longitudinal direction |

The invention claimed is:

1. A knitting tool (1) comprising:

a shank (2), which extends essentially in a longitudinal direction (z) in which the knitting tool (1) is moved during knitting, wherein the shank (2) has, at every point along its length, a cross-sectional surface (8) which extends orthogonally with respect to the longitudinal direction (z) and along lateral (y) and elevational (x) directions, wherein each of the cross-sectional surfaces (8) has a centroid (9), through which an imaginary center-of-gravity line (4) runs that interconnects centroids (9) of all the cross-sectional surfaces (8) along the longitudinal direction (z), wherein the shank (2) has at least one functional portion (5) in which the imaginary center-of-gravity line (4) has a continuously varying height along a length of the at least one functional portion (5), and in which a height dimension of the cross-sectional surface (8) in the elevational (x) direction is smaller at every point along a length of the at least one functional portion (5) than a height of the shank (6) within the at least one functional portion (5), wherein the height of the shank (6) within the at least one functional portion is a distance, in the elevational direction (x), between a lowest point of the shank (2) in the elevational direction (x) and a highest point of the shank (2) in the elevational direction (x) within the at least one functional portion (5), and wherein the length of the at least one functional portion (5) is more than 20% of a length of the knitting tool (1), wherein a top surface (10) of the shank (6) in the at least one functional portion (5) has a continuously varying height and/or wherein a bottom surface (13) of the shank (6) in the at least one functional portion (5) has a continuously varying height such that at least one of the top surface (10) and bottom surface (13) of the shank (6) has no portion that extends parallel to the longitudinal direction (z) within the at least one functional portion, the knitting tool (1) further comprising at least one butt (18), wherein the at least one functional portion (5) comprises at least two sub-portions (33) in which the imaginary center-of-gravity line (4) has a continuously varying height along a length thereof, wherein the at least two sub-portions (33) are spaced apart from each other in the longitudinal direction (z), wherein at least one sub-portion (33) of the at least two sub-portions (33) of the at least one functional portion (5) precedes the at least one butt (18) in the longitudinal direction (z) and at least another sub-portion (33) of the at least two sub-portions (33) of the at least one functional portion (5) follows the at least one butt in the longitudinal direction (z).

2. The knitting tool (1) according to claim 1,
wherein at least one sub-portion (33) of the at least two sub-portions of the at least one functional portion (5) adjoins the at least one butt (18) directly or is spaced apart from the at least one butt (18) only by a distance in the longitudinal direction (z) which is less than or equal to 10% of the length of the knitting tool.

3. The knitting tool (1) according to claim 1,
wherein the at least one functional portion (5) has at least one local minimum or maximum elevational extreme (14, 15) of the imaginary center-of-gravity line (4), and
wherein at the at least one local minimum or maximum elevational extreme, a gradient of the imaginary center-of-gravity line (4) is zero.

4. The knitting tool (1) according to claim 3,
wherein the top surface (10) of the shank (2) facing a positive elevational direction (x) has a same height at positions, in the longitudinal direction (z), of at least two local maxima (14) of the imaginary center-of-gravity line (4) and/or the bottom surface of the shank (2) facing a negative elevational direction (x) has a same height at positions of at least two local minima (15) of the imaginary center-of-gravity line (4).

5. The knitting tool (1) according to claim 4,
wherein the shank (2) comprises lateral surfaces facing in the lateral direction (y), and at least one of the lateral surfaces is raised laterally (y) relative to a majority of the at least one functional portion (5) at the position of at least one of the at least two local maxima (14).

6. The knitting tool (1) according to claim 1,
wherein at positions of local maxima (14) of the imaginary center-of-gravity line (4), the shank (2) is spaced apart from a minimum shank height (11) of the at least one functional portion (5), and
at positions of local minima (15) of the imaginary center-of-gravity line (4), the shank (2) is spaced apart from a maximum shank height (12) of the at least one functional portion (5).

7. The knitting tool (1) according to claim 1,
wherein at least one sub-portion (33) of the at least one functional portion (5) forms, in an x-z plane, at least one triangular recess (19).

8. The knitting tool (1) according to claim 7,
wherein the top surface (10) of the shank (2) which faces a positive elevational direction (x) of the knitting tool (1) forms a dirt catch comprising a protuberance that has a gradient course which, in a positive longitudinal direction (z) pointing in an extension direction of the knitting tool (1), has a local gradient maximum (40) in front of at least one local height maximum (14) of the imaginary center-of-gravity line, and/or
the bottom surface of the shank (2) which faces a negative elevational direction (x) of the knitting tool (1) forms a dirt catch comprising a protuberance that has a gradient course which, in the positive longitudinal direction (z), has a local gradient minimum (41) in front of at least one local height minimum (15) of the imaginary center-of-gravity line (4).

9. The knitting tool (1) according to claim 8,
wherein an absolute value of the local gradient maximum (40) of the top surface (10) and/or an absolute value of the local gradient minimum (41) of the bottom surface (13) is between 0.57 and 2.75.

10. The knitting tool (1) according to claim 1,
wherein the top surface of the shank (2) which faces a positive elevational direction (x) of the knitting tool (1) and the bottom surface of the shank (2) which faces a negative elevational direction (x) of the knitting tool (1) are parallel to each other along an entire length of the-at least one functional portion (5).

11. The knitting tool (1) according to claim 1,
wherein a last maximum (14), in a negative longitudinal direction (z) of the knitting tool (1) of the imaginary enter-of-gravity line (4) of the at least one functional portion (5) is a global maximum (42).

12. A knitting device (27), comprising:
at least one needle slot (28), which is configured to receive and, during operation, to guide a knitting tool (1), and
at least one knitting tool (1) according to claim 1.

13. The knitting device (27) according to claim 12,
wherein a length of the at least one needle slot (28) in the longitudinal direction (z) of the knitting tool (1), a reach of the at least one functional portion (5) in the longitudinal direction (z) of the knitting tool (1), a magnitude of a stroke (34) of a knitting movement of the knitting tool (1) during knitting are mutually coordinated such that at least 80% of the reach of the at least one functional portion (5) of the knitting tool (1), in the longitudinal direction (z), remains within the at least one needle slot (28) during knitting.

14. The knitting device (27) according to claim 13,
wherein an upper edge (36) of the at least one needle slot (28) is spaced in the elevational direction (x) by a maximum of 0.5 mm from a highest point (39) of the top surface of the shank (2) facing a positive elevational direction (x) of the knitting tool (1).

15. The knitting device (27) according to claim 14, wherein:
the at least one butt (18) is raised in the positive elevational direction (x) relative to the at least one functional portion (5),
the at least one butt (18) engages in a cam curve recess (30) of the knitting device (27), and
a highest point (39), in the positive elevational direction (x), of the top surface of the shank (2) is spaced apart from the cam curve recess (30) in the longitudinal direction (z).

16. The knitting tool (1) according to claim 1,
wherein a majority of the at least one functional portion is positioned aft of the at least one butt (18) in the longitudinal direction (z).

17. The knitting tool (1) according to claim 1,
wherein the length of the at least one functional portion (5) is more than 25% of the length of the knitting tool (1).

* * * * *